United States Patent [19]

Nishizima et al.

[11] 4,286,035

[45] Aug. 25, 1981

[54] HALOGEN DOPED SELENIUM-TELLURIUM ALLOY ELECTROPHOTOGRAPHIC PHOTOCONDUCTOR

[75] Inventors: Hideyo Nishizima; Hideaki Ema, both of Numazu; Hiroshi Tamura, Fujisawa; Hideki Akiyoshi, Numazu, all of Japan

[73] Assignee: Ricoh Company, Ltd., Tokyo, Japan

[21] Appl. No.: 153,963

[22] Filed: May 28, 1980

[30] Foreign Application Priority Data

May 31, 1979 [JP] Japan .....54-66780

[51] Int. Cl.[3] ..... G03G 5/04

[52] U.S. Cl. ..... 430/85; 430/86; 430/95; 430/128

[58] Field of Search ..... 430/86, 95, 69, 85, 430/128

[56] References Cited

U.S. PATENT DOCUMENTS 3,990,894 11/1976 Kinoshita et al. ..... 430/85 X

FOREIGN PATENT DOCUMENTS 2056013 5/1971 Fed. Rep. of Germany ..... 430/85
1441447 6/1967 United Kingdom ..... 430/86
1135460 12/1968 United Kingdom ..... 430/85

*Primary Examiner*—John D. Welsh
*Attorney, Agent, or Firm*—Oblon, Fisher, Spivak, McClelland & Maier

[57] ABSTRACT

An electrophotographic photoconductor comprising an electroconductive base and a photosensitive layer formed thereon, the photosensitive layer comprising a selenium-tellurium alloy with a concentration of tellurium in the range of 5 to 20 wt. % and halogen, with a concentration in the range of 5 to 500 ppm, selected from the group consisting of fluorine, chlorine, bromine and iodine, in the photosensitive layer, with the concentration of tellurium substantially uniform or increasing in the direction toward the surface of the photosensitive layer and the ratio of the concentration of tellurium near the electroconductive base to the concentration of tellurium near the surface of said photosensitive layer being 65 or more:100.

6 Claims, 2 Drawing Figures

HALOGEN DOPED SELENIUM-TELLURIUM ALLOY ELECTROPHOTOGRAPHIC PHOTOCONDUCTOR

BACKGROUND OF THE INVENTION

The present invention relates to an electrophotographic photoconductor and more particularly to an electrophotographic selenium-tellurium photoconductor.

As a method of increasing the photosensitivity of an electrophotographic selenium photoconductor, a method of adding tellurium to the selenium photoconductor is known. However, the characteristics of selenium may be considerably impaired depending upon the amount of tellurium added or the manner of its addition, so that the selenium photoconductor may not be sufficiently sensitized and accordingly cannot be used in practice.

In order to improve that point, an electrophotographic photoconductor plate comprising a photosensitive layer comprising a selenium-tellurium alloy and halogen is proposed in Japanese Laid-open Patent Application Ser. No. 50-142036, in which the concentration of tellurium in the photosensitive layer is uniform in the direction parallel to the surface of the photoconductor, while the concentration of tellurium gradually increases in the direction normal to the surface of the photoconductor. More specifically, the concentration of tellurium near the surface of the photoconductor is in the range of 5 to 20 wt. %, while the concentration of tellurium is not more than 5 wt. % near the base plate.

Furthermore, a selenium electrophotographic photoconductor has been proposed, in which the concentration of tellurium in the photosensitive layer increases in the direction normal to the surface of the photoconductor and the concentration of tellurium is higher near the surface of the photoconductor. However, when such a selenium electrophotographic photoconductor is used in practice in an electrophotographic copying machine, black lines appear in the copy due to uneven abrasion of the photosensitive layer.

Generally, the photosensitivity of a photoconductor is proportional to the product of (i) the number of charge carriers produced in the photoconductor by the light projected thereto and (ii) the drift mobilities of the charge carriers. In the photoconductor comprising a selenium-tellurium alloy, the number of charge carriers to be produced by the light projected thereto depends upon the concentration of tellurium contained in the $1\sim3\mu$ surface layer of the photoconductor, while the drift mobilities of charge carriers also depend upon the concentration of tellurium in the inner layer below the surface layer. If the concentration of tellurium contained in the $1\sim3\mu$ surface layer of the photoconductor is constant, the photosensitivity of the selenium-tellurium alloy photoconductor depends upon the drift mobilities of charge carriers. The drift mobilities of charge carriers in the inner selenium-tellurium layer are minimum when the concentration of tellurium therein is about 4 wt. % and increase in a parabolic shape (if plotted) outside the above-mentioned minimum range of about 4 wt. %.

Therefore, such a range of concentration of tellurium as minimizes the mobilities of charge carriers in the selenium-tellurium alloy layer has to be avoided.

Practically, in the electrophotographic photoconductor comprising an electroconductive base and a photosensitive layer formed thereon, which comprises a selenium-tellurium alloy, it is preferable that the concentration of tellurium in the photosensitive layer be 5 wt. % or more, more preferably 8 wt. % or more, and that the concentration be substantially uniform in the direction normal to the surface of the photoconductor, from the view point of the photosensitivity of the photoconductor.

SUMMARY OF THE INVENTION

It is therefore an object of the present invention to provide an electrophotographic photoconductor comprising an electroconductive base and a photosensitive layer formed thereon, which comprises a selenium-tellurium alloy with a concentration of tellurium in the range of 5 to 20 wt. %, and halogen in the range of 5 to 500 ppm in the photosensitive layer and in which the concentration of tellurium is substantially uniform in the direction normal to the surface of the photosensitive layer.

According to the present invention, since the concentration of tellurium is substantially uniform in the direction normal to the surface of the photoconductive layer, it is prevented that the distribution of tellurium in the surface layer of the photoconductor becomes non-uniform while in use. Furthermore, the photosensitivity and other characteristics including residual potential of the photoconductor are improved by addition of halogen thereto.

DETAILED DESCRIPTION OF THE PREFERRED EMBODIMENTS

In each embodiment of the electrophotographic photoconductors according to the present invention, the concentration of tellurium in the photosensitive layer is substantially uniform in the direction normal to the surface of the photosensitive layer.

More specifically, by "substantially uniform" it is meant that, with the concentration of tellurium near the electroconductive base at 5 wt. % or more, the concentration in the direction toward the surface of the photosensitive layer (normal to said surface) will be uniform or increase; however, if the ratio of (i) the concentration near the electroconductive base to (ii) the concentration near the surface of the photosensitive layer is 65 to 100:100, the concentration is said to be substantially uniform.

Furthermore, "near the electroconductive base" means the range in the photosensitive layer of 1 to $3\mu$ from the interface between the photosensitive layer and the electroconductive base. And "near the surface of the photosensitive layer" means the range of 1 to $3\mu$ in the photosensitive layer from the top surface thereof.

In an electroconductive selenium-tellurium photoconductor according to the present invention, the upper limit of the concentration of tellurium in the photosensitive layer is 20 wt. %, because the addition of tellurium also has the effect to altering the structure of the selenium from an amorphous state to a crystalline state, and beyond the limit of 20 wt. % the change is so great that the photoconductor cannot be used. It has been found that the most desirable range of the concentration of tellurium is from 8 to 12 wt. %.

The concentration of tellurium in the photosensitive layer of the photoconductor can be adjusted by using, for example, two different evaporation sources, with selenium being placed in one evaporation source and tellurium in the other evaporation source, or by using a single evaporation source for holding a selenium-tellurium alloy, which has a shutter for closing the evaporation source until the temperature thereof is elevated to a predetermined temperature and then opening the same for a predetermined period of time for evaporation and then closing at a predetermined time.

In addition, in the electrophotographic selenium-tellurium photoconductor according to the present invention, halogen is added to reduce the residual potential thereof and to improve other electric characteristics thereof. As a halogen, iodine, chlorine, fluorine and bromine can be used in a range of 5~500 ppm. If less than 5 ppm of halogen is added, no effect is observed, and if more than 500 ppm is added, the photoconductor cannot be charged to the desired potential. Furthermore, within the range of 5~500 ppm, the most effective amount of halogen to be added will vary depending upon which substance (iodine, chlorine, fluorine or bromine) is added, because their atomic weights vary.

Figure 1:
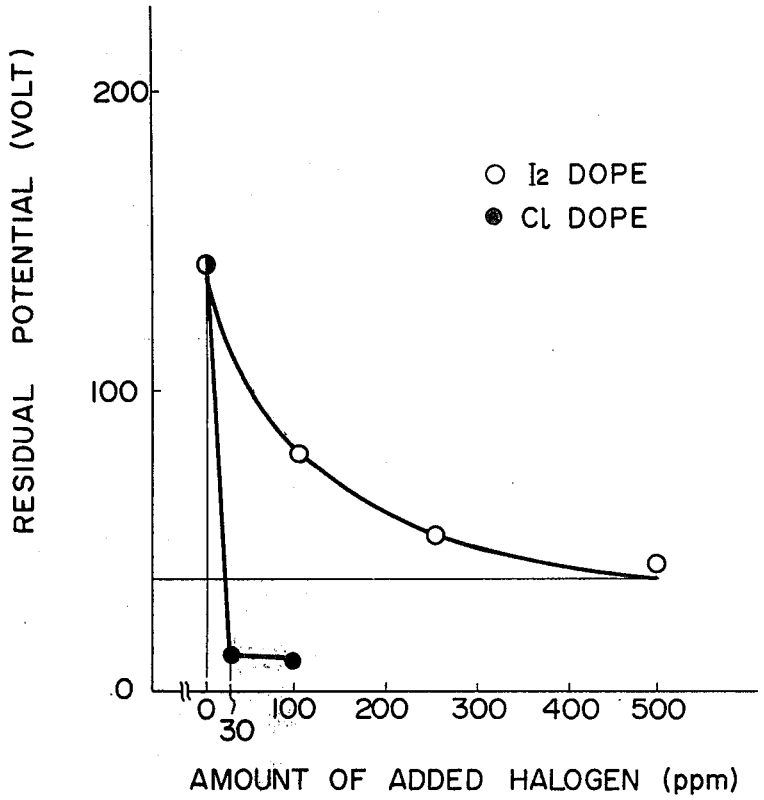
FIG. 1 illustrates the decrease in residual potential of an electrophotographic selenium-tellurium alloy photoconductor according to the present invention, with a concentration of tellurium in the photosensitive layer of 9 wt. %, as iodine and chlorine are added, respectively.

FIG. 1 illustrates the decrease in residual potential of an electrophotographic photoconductor according to the present invention, with a concentration of tellurium in the photosensitive layer of 9 wt. %, as iodine and chlorine are added respectively, as described above. In the case of iodine, the residual potential decreases steadily as increased amounts thereof are added through the addition of 500 ppm thereof. In the case of chlorine, addition of amounts thereof up to 30 ppm reduces the residual potential of the photoconductor very abruptly; from 30 ppm to 100 ppm, further decrease in the residual potential is slight. It can also be seen from FIG. 1 that the residual potential is reduced lower by the addition of 100 ppm of chlorine than by the addition of 500 ppm of iodine.

Figure 2:
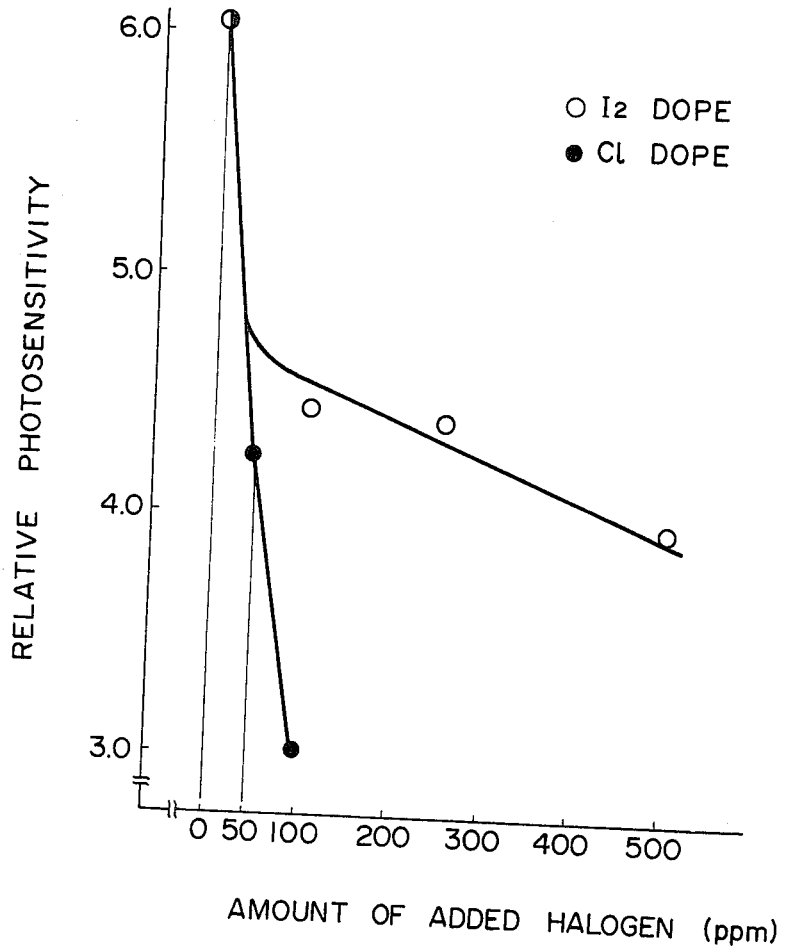
FIG. 2 illustrates the increase in relative photosensitivity of an electrophotographic selenium-tellurium alloy photoconductor according to the present invention, with a concentration of tellurium in the photosensitive layer of 8 wt. %, as iodine and chlorine are added, respectively.

"Relative photosensitivity" was determined as follows: The surface of each photoconductor according to the present invention was charged up to 1,000 volts by corona charging and thereafter, 60 lux of illumination was applied for the period of time necessary to reduce the surface potential to 100 volts by use of a standard light source (2854° K.) with a DM filter, which can cut out light with wavelengths shorter than 460 mμ and light with wavelengths longer than 700 mμ. This procedure was repeated 100 times. For the 100th illumination, the time necessary to reduce the surface potential to 100 volts was measured. This time for the 100th illumination, plotted in seconds as the ordinate of FIG. 2, is the relative photosensitivity of the photoconductors with varing amounts of halogen added in this experiment. In FIG. 2, the shorter the time, the higher the photosensitivity.

As FIG. 2 shows, in the case of chlorine, relative photosensitivity improves steadily (the illumination time to reduce the surface potential to 100 volts decreases) as chlorine is added up to 100 ppm thereof. In the case of iodine, relative photosensitivity increases rapidly with the addition of up to approximately 50 ppm thereof, and thereafter gradually with the addition of up to 500 ppm. It can also be seen from FIG. 2 that relative photosensitivity is more significantly improved by the addition of 100 ppm of chlorine than by the addition of 500 ppm of iodine.

The following are examples of formulations of electrophotographic photoconductors, in which examples 1A through 5A are the embodiments of selenium-tellurium photoconductors according to the present invention, while examples 1B through 5B are for comparison with the examples 1A through 5A, respectively.

EXAMPLE 1A

In a vacuum chamber an electroconductive aluminum base plate was placed above selenium in an evaporation source with the addition of 100 ppm of chlorine as a halogen, and tellurium in the amount of 10 wt. % with respect to the selenium in another evaporation source. The temperature of the aluminum base plate was maintained at 75° C., while the selenium with chlorine was heated to 300° C. and the tellurium was heated to 500° C. Evaporation was permitted to continue until a layer of selenium-tellurium alloy doped with chloride with a thickness of 50μ was formed on the aluminum base plate, forming the electrophotographic photoconductor.

Thereafter, the electrophotographic photoconductor formed as described above was subjected to X-ray micro-analysis by an X-ray micro-analyzer, whereby the distribution of the tellurium in the direction toward the surface of the electrophotographic photoconductor was measured. It was found that near the base plate, in the intermediate area, and near the surface of the photoconductor, the concentration of tellurium was a uniform 10 wt. %.

This photoconductor was also tested for relative photosensitivity, as described in the discussion concerning FIG. 2, above. Relative photosensitivity as thus measured was 4.5 seconds (good, in comparison with that of Example 1B, below).

Thereafter, this photoconductor was used in a copy machine to make 30,000 standard copies. At the end of that test period, none of the aforementioned black lines appeared in the copies, and the resistance to abrasion of the photoconductor was determined to be good.

EXAMPLE 1B

In the same vacuum apparatus as in Example 1A, a mixture machanically mixed for uniformity of (i) selenium and (ii) a selenium-12 wt. % tellurium alloy with 100 ppm chlorine added, such that the tellurium constituted 8 wt. % of the entire mixture of (i) and (ii), was placed in a single evaporation source below an electroconductive base plate (aluminum). The temperature of the electroconductive base plate was maintained at 75° C., while the mixture in the evaporation source was first heated at 280° C. for 10 minutes, then at 310° C. for 7 minutes, resulting in a layer of selenium-tellurium alloy doped with chlorine with a thickness of 50μ being formed on the electroconductive base plate, thus forming the electrophotographic photoconductor.

Thereafter, the electrophotographic conductor formed as described above was subjected to X-ray micro-analysis, whereby the distribution of the tellurium in the direction toward the surface of the photoconductor was measured. It was found that near the base plate the tellurium concentration was 4 wt. %; in the intermediate area, 8 wt. %; and near the surface of the photoconductor, 10 wt. %.

This photoconductor was also tested for relative photosensitivity, as described in the discussion concerning FIG. 2, above. Relative photosensitivity as thus measured was 6 seconds (poor, in comparison with that of Example 1A. above).

Thereafter, this photoconductor was used in a copy machine to make 30,000 standard copies. At the end of this test period, the aforementioned black lines had appeared in the copies, and the performance of this photoconductor could thus be determined to be inadequate.

EXAMPLE 2A

In the same vacuum apparatus as in Example 1A, a selenium-9 wt. % tellurium alloy doped with 50 ppm chlorine was placed in a single evaporation source below an aluminum base plate. The temperature of the aluminum base plate was maintained at 80° C., while the selenium-tellurium alloy in the evaporation source was heated at 350° C. to evaporate the alloy, resulting in a layer of selenium-tellurium alloy doped with chlorine with a thickness of 60μ being formed on the alluminum base plate, thus forming the electrophotographic photoconductor.

Thereafter, the electrophotographic photoconductor formed as described above was subjected to X-ray micro-analysis, whereby the distribution of the tellurium in the direction toward the surface of the photoconductor was measured. It was found that near the base plate the tellurium concentration was 6.5 wt. %; in the intermediate area, 8 wt. %; concentration was 6.5 wt. %; in the intermediate area, 8 wt. %; and near the surface of the photoconductor, 9.5 wt. %.

This photoconductor was also tested for relative photosensitivity before and after it was in a copying machine to make 110,000 standard copies. It was found that the relative photosensitivity was maintained at 3.7 seconds before and after the copy test.

EXAMPLE 2B

In the same vacuum apparatus in Example 1A, the same selenium-9 wt. % tellurium alloy doped with 50 ppm chlorine as in Example 2A was placed in a single evaporation source below an aluminum base plate. The temperature of the aluminum base plate was maintained at 75° C., while the selenium-tellurium alloy in the evaporation source was heated at 310° C. to evaporate the alloy, resulting in a layer of selenium-tellurium alloy doped with chlorine with a thickness of 60μ being formed on the aluminum base plate, thus forming the electrophotographic photoconductor.

Thereafter, the electrophotographic photoconductor formed as described above was subjected to X-ray micro-analysis, whereby the distribution of the tellurium in the direction toward the surface of the photoconductor was measured. It was found that near the base plate the tellurium concentration was 4.5 wt. %; in the intermediate area, 6.5 wt. %; and near the surface of the photoconductor, 9.5 wt. %.

This photoconductor was also tested for relative photosensitivity before and after it was used in a copying machine to make 110,000 standard copies. The relative photosensitivity was 4.5 seconds before the copy test and 5.5 seconds after the copy test. Thus, the photosensitivity was reduced during the copy test.

EXAMPLE 3A

In the same vacuum apparatus as in Example 1A, a selenium-8 wt. % tellurium alloy doped with 30 ppm chlorine was placed in a single evaporation source below an aluminum base plate. The temperature of the aluminum base plate was maintained at 70° C., while the selenium-tellurium alloy in the evaporation source was heated at 330° C. to evaporate the alloy, resulting in a layer of selenium-tellurium alloy doped with chlorine with a thickness of 65μ being formed on the aluminum base plate, thus forming the electrophotographic photoconductor.

The electrophotographic photoconductor formed as described above was subjected to X-ray micro-analysis, whereby the distribution of the tellurium in the direction toward the surface of the photoconductor was measured. It was found that near the base plate the tellurium concentration was 6.0 wt. %; in the intermediate area, 7.0 wt. %; and near the surface of the photoconductor, 8.5 wt. %.

Thereafter, this photoconductor was used in copying machine to make 80,000 standard copies. At the end of this test period, none of the aforementioned black lines had appeared in the copies and no defect in image quality was found.

EXAMPLE 3B

In the same vacuum apparatus as in Example 1A, the same selenium-8 wt. % tellurium alloy doped with 30 ppm chlorine as in Example 3A was placed in a single evaporation source below an aluminum base plate. The temperature of the aluminum base plate was maintained at 70° C., while the selenium-tellurium alloy in the evaporation source was heated at 300° C. to evaporate the alloy, resulting in a layer of selenium-tellurium alloy doped with chlorine with a thickness of 65μ being formed on the aluminum base plate, thus forming the electrophotographic photoconductor.

Thereafter, the electrophotographic photoconductor formed as described above was subjected to X-ray micro-analysis, whereby the distribution of the tellurium in the direction toward the surface of the photoconductor was measured. It was found that near the base plate the tellurium concentration was 4.0 wt. %; in the intermediate area, 6.0 wt. %; and near the surface of the photoconductor, 8.5 wt. %.

This photoconductor was used in a copying machine to make 80,000 standard copies. In contrast to Example 3A, the aforementioned black lines appeared in the copies, and the performance of this photoconductor could thus be determined to be inadequate.

EXAMPLE 4A

In the same vacuum apparatus as in Example 1A, a selenium-10 wt. % tellurium alloy doped with 250 ppm iodine was placed in a single evaporation source below an aluminum base plate. The temperature of the aluminum base plate was maintained at 75° C., while the selenium-tellurium alloy in the evaporation source was heated at 350° C. to evaporate the alloy, resulting in a layer of selenium-tellurium alloy doped with iodine with a thickness of 55μ being formed on the aluminum base plate, thus forming the electrophotographic photoconductor.

Thereafter, the electrophotographic photoconductor formed as described above was subjected to X-ray micro-analysis, whereby the distribution of the tellurium in the direction toward the surface of the photoconductor was measured. It was found that near the base plate the tellurium concentration was 7.0 wt. %; in the intermediate area, 8.5 wt. %; and near the surface of the photoconductor, 9.5 wt. %.

This photoconductor was also tested for relative photosensitivity before and after it was used in a copying machine to make 20,000 standard copies. It was found that the relative photosensitivity was maintained at 3.4 seconds before and after the copy test. At the end of that test period, some scratches were observed in the photoconductor, but it was found that they did not have any particular adverse effect on the image quality of the copies.

EXAMPLE 4B

In the same vacuum apparatus as in Example 1A, the same selenium-10 wt. % tellurium alloy doped with 250 ppm iodine as in Example 4A was placed in a single evaporation source below an aluminum base plate. The temperature of the aluminum base plate was maintained at 75° C., while the selenium-tellurium alloy in the evaporation source was heated at 310° C. to evaporate the alloy, resulting in a layer of selenium-tellurium alloy doped with iodine with a thickness of 62$\mu$ being formed on the aluminum base plate, thus forming the electrophotographic photoconductor.

Thereafter, the electrophotographic photoconductor formed as described above was subjected to X-ray micro-analysis, whereby the distribution of the tellurium in the direction toward the surface of the photoconductor was measured. It was found that near the base plate the tellurium concentration was 4.0 wt. %; in the intermediate area, 7.2 wt. %; and near the surface of the photoconductor, 9.5 wt. %.

This photoconductor was also tested for relative photosensitivity before and after it was used in a copying machine to make 20,000 standard copies. The relative photosensitivity was 4.0 seconds before the copy test and 4.5 seconds after the copy test. Thus, the photosensitivity decreased during the copy test. At the end of that test period, some scratches were observed as in Example 4A, and in contrast to Example 4A, it was found that the scratches did have adverse effect on the image quality of the copies and the aforementioned black lines appeared in the copies.

EXAMPLE 5A

In the same vacuum apparatus as in Example 1A, a selenium-14 wt. % tellurium alloy doped with 500 ppm iodine was placed in a single evaporation source below an aluminum base plate. The temperature of the aluminum base plate was maintained at 75° C., while the selenium-tellurium alloy in the evaporation source was heated at 360° C. to evaporate the alloy, resulting in a layer of selenium-tellurium alloy doped with iodine with a thickness of 55$\mu$ being formed on the aluminum base plate, thus forming the electrophotographic photoconductor.

Thereafter, the electrographic photoconductor formed as described above was subjected to X-ray micro-analysis, whereby the distribution of the tellurium in the direction toward the surface of the photoconductor was measured. It was found that near the base plate the tellurium concentration was 10 wt. %; in the intermediate area, 11 wt. %; and near the surface of the photoconductor, 12.5 wt. %.

This photoconductor was also tested for relative photosensitivity before and after it was used in a copying machine to make 30,000 standard copies. It was found that the relative photosensitivity was maintained at 2.5 seconds before and after the copy test. EXAMPLE 5B In the same vacuum apparatus as in Example 1A, a selenium-14 wt. % tellurium alloy doped with 500 ppm iodine was placed in a single evaporation source below an aluminum base plate. The temperature of the aluminum base plate was maintained at 75° C., while the selenium-tellurium alloy in the evaporation source was heated at 310° C. to evaporate the alloy, resulting in a layer of selenium-tellurium alloy doped with iodine with a thickness of 62$\mu$ being formed on the aluminum base plate, thus forming the electrophotographic photoconductor.

Thereafter, the electrophotographic photoconductor formed as described above was subjected to X-ray micro-analysis, whereby the distribution of the tellurium in the direction toward the surface of the photoconductor was measured. It was found that near the base plate the tellurium concentration was 5.5 wt. %; in the intermediate area, 8.5 wt. %; and near the surface of the photoconductor, 12.5 wt. %.

This photoconductor was also tested for relative photosensitivity before and after it was used in a copying machine to make 30,000 standard copies. The relative photosensitivity was 3.0 seconds before the copy test and 3.4 seconds after the copy test. Thus, the photosensitivity decreased.

Furthermore, in contrast to Example 5A, the aforementioned black lines appeared considerably in the copies, and the performance of this photoconductor could thus be determined to be inadequate.

What is claimed is:

1. An electrophotographic photoconductor comprising an electroconductive base and a photosensitive layer formed thereon, said photosensitive layer comprising a selenium-tellurium alloy with a concentration of tellurium in the range of 5 to 20 wt. % and halogen, with a concentration in the range of 5 to 500 ppm, selected from the group consisting of fluorine, chlorine, bromine and iodine, in said photosensitive layer, the concentration of tellurium near said electroconductive base being at 5 wt. % or more and being uniform or increasing in the direction toward the surface of said photosensitive layer and the ratio of the concentration of tellurium near said electroconductive base to the concentration of tellurium near the surface of said photosensitive layer being 65 to 100:100.

2. An electrophotographic photoconductor comprising an electroconductive base and a photosensitive layer formed thereon, said photosensitive layer comprising a selenium-tellurium alloy with a concentration of tellurium in the range of 5 to 20 wt. % and halogen, with a concentration in the range of 5 to 500 ppm, selected from the group consisting of fluorine, chlorine, bromine and iodine, in said photosensitive layer, the concentration of tellurium near said electroconductive base being at 5 wt. % or more and being uniform or increasing in the direction toward the surface of said photosensitive layer and the ratio of the concentration of tellurium near said electroconductive base to the concentration of tellurium near the surface of said photosensitive layer being 80 to 100:100.

3. An electrophotographic photoconductor comprising an electroconductive base and a photosensitive layer formed thereon, said photosensitive layer comprising a selenium-tellurium alloy with a concentration of tellurium in the range of 8 to 10 wt. % and chlorine with a concentration in the range of 30 to 100 ppm in said photosensitive layer, the concentration of tellurium near said electroconductive base being at 6 wt. % or more and being uniform or increasing in the direction toward the surface of said photosensitive layer and the ratio of the concentration of tellurium near said electroconductive base to the concentration of tellurium near the surface of said photosensitive layer being 65 to 100:100.

4. An electrophotographic photoconductor as claimed in claim 3, wherein said electroconductive base is aluminum and said photosensitive layer is of a thickness in the range of 50 to 65μ.

5. An electrophotographic photoconductor comprising an electroconductive base and a photosensitive layer formed thereon, said photosensitive layer comprising a selenium-tellurium alloy with a concentration of tellurium in the range of 10 to 14 wt. % and iodine with a concentration in the range of 250 to 500 ppm in said photosensitive layer, the concentration of tellurium near said electroconductive base being at 7 wt. % or more and being uniform or increasing in the direction toward the surface of said photosensitive layer and the ratio of the concentration of tellurium near said electroconductive base to the concentration of tellurium near the surface of said photosensitive layer being 65 to 100:100.

6. An electrophotographic photoconductor as claimed in claim 5, wherein said electroconductive base is aluminum and said photosensitive layer is of a thickness in the range of 50 to 65μ.

* * * * *

UNITED STATES PATENT AND TRADEMARK OFFICE

CERTIFICATE OF CORRECTION

PATENT NO. 4,286,035

DATED August 25, 1981

INVENTOR(S) Hideyo Nishizima et al

It is certified that error appears in the above—identified patent and that said Letters Patent is hereby corrected as shown below:

On the title page in the abstract, last line, "65 or more: 100" should read -- 65 to 100: 100 --.

Signed and Sealed this

*Eleventh* Day of *May 1982*

[SEAL]

*Attest:*

GERALD J. MOSSINGHOFF

*Attesting Officer*

*Commissioner of Patents and Trademarks*